United States Patent [19]

Dressler

[11] Patent Number: 4,497,250

[45] Date of Patent: Feb. 5, 1985

[54] INK FOUNTAIN

[75] Inventor: Frederick K. Dressler, East Hartland, Conn.

[73] Assignee: Motter Printing Press Co., York, Pa.

[21] Appl. No.: 465,027

[22] Filed: Feb. 8, 1983

[51] Int. Cl.[3] ..... B41F 31/06; B41F 31/08; B41F 31/04

[52] U.S. Cl. ..... 101/350; 101/366; 101/425

[58] Field of Search ..... 101/363, 364, 350, 426, 101/351, 352, 365, 366, 148, 425, 206, 208

[56] References Cited

U.S. PATENT DOCUMENTS

| | | | |
|---|---|---|---|
| Re. 24,161 | 6/1956 | Rogge et al. . | |
| 3,163,111 | 12/1964 | Knowles et al. | 101/350 |
| 4,009,657 | 3/1977 | Bonanno et al. | 101/366 X |
| 4,158,333 | 6/1979 | Navi | 101/363 |
| 4,244,292 | 1/1981 | Williams | 101/364 X |
| 4,263,848 | 4/1981 | Matalia et al. | 101/364 X |

*Primary Examiner*—J. Reed Fisher

*Attorney, Agent, or Firm*—Brumbaugh, Graves, Donohue & Raymond

[57] ABSTRACT

An inking fountain for a printing press, preferably for a high speed flexographic press, includes an ink applicator and a pre-inking applicator. In the pre-inking applicator, the roller is partially immersed in ink, and thereafter encounters a pre-wiper element, which is closely spaced from the roller and has a leading surface arranged at an angle for forcing ink against the roller surface. A knife is arranged at the leading edge of the ink applicator, for interrupting the boundary layer of air on the roller prior to the roller surface entering the fountain cavity. Within the cavity, which preferably includes baffles, ink is fed and applied to the roller surface. Excess ink is scraped from the roller surface, by a reverse angle doctor blade, as the roller leaves the cavity. In such manner, the press can be operated at high speed without starvation or foaming of the ink, as in conventional systems. Also, a cleaning system is provided for readily washing the press at the end of each run.

15 Claims, 1 Drawing Figure

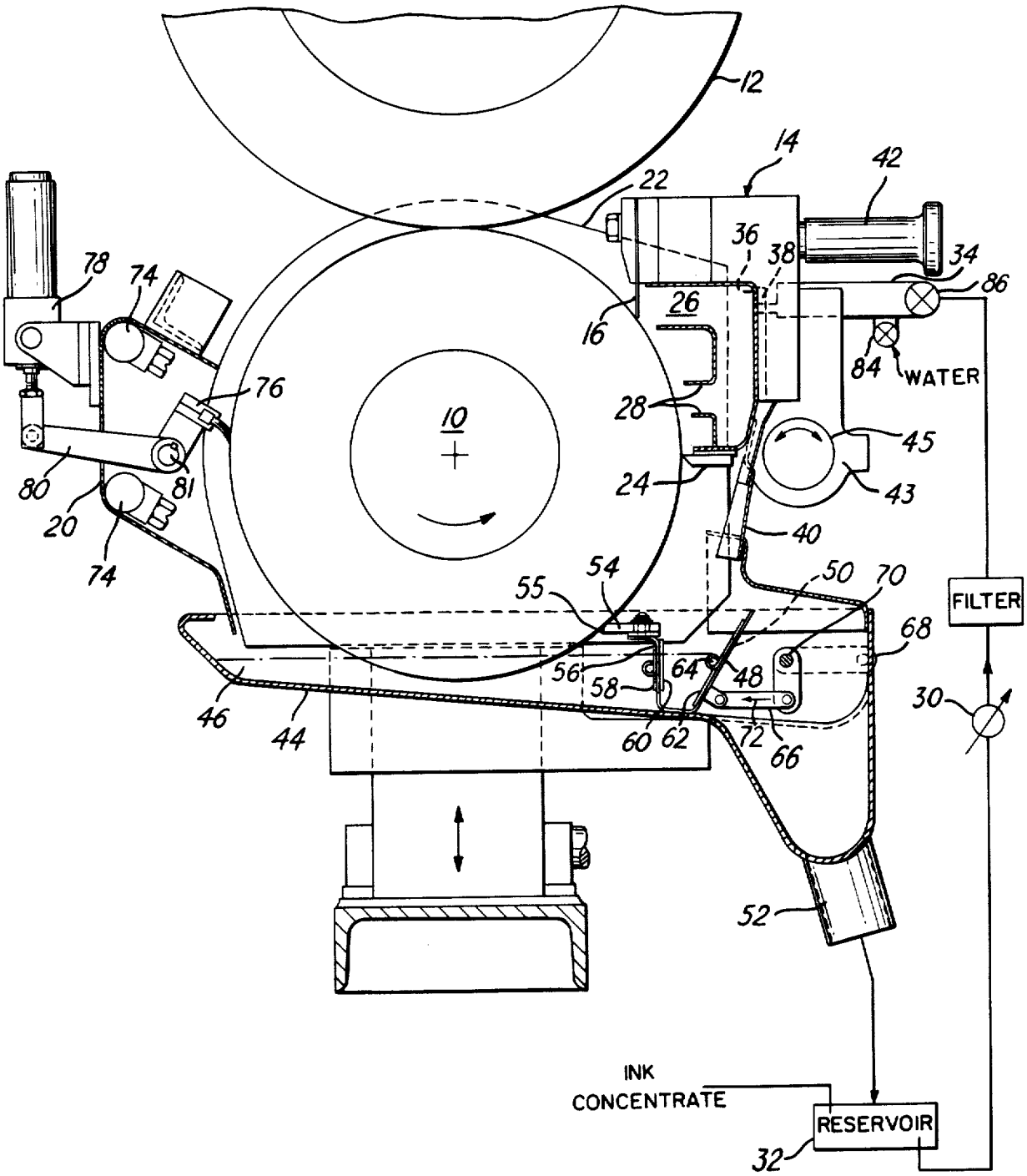
12
14
42
22
36
38
34
86
78
74
26
16
84
WATER
76
10
28
45
80
81
24
43
20
40
74
54
50
70
55
FILTER
68
56
64
48
58
30
46
44
60
62
72
66
52
INK
CONCENTRATE
RESERVOIR
32

INK FOUNTAIN

BACKGROUND OF THE INVENTION

The present invention relates to improvements in a printing press, particularly of the type used in flexographic printing.

Flexography is a specialized form of relief printing which is used on materials having surfaces not easily handled by ordinary letterpress methods, for example for printing plastic packaging. Flexographic presses may also be used for process color printing.

In flexographic presses, an inking roller is supplied with ink from a flexographic ink fountain. The inking roller has a plurality of depressions or cells which are filled with ink, and a reverse angle doctor blade, which bears against the roller surface, scrapes off excess ink from the inking roller surface, so as to leave ink only in the depressions. The inked roller rotates into contact with the printing cylinder, where the ink is transferred to the printing cylinder.

Conventional flexographic presses operate at speeds up to about a thousand feet per minute, which is slower than the operating capabilities of other printing methods, e.g. intaglio printing presses. Flexographic presses are generally incapable of running in speeds in excess of one thousand feet per minute, since two adverse phenomena occur: starvation and foaming. Starvation means that insufficient ink is transferred from the ink fountain to the inking roller to achieve satisfactory printing. Foaming refers to aeration of the ink in the ink fountain, which further exacerbates the problem of starvation.

In addition to the limitation in press speed inherent in flexographic presses, the inks commonly used in flexographic presses, i.e. aniline ink or water based inks, tend to dry quickly. As a result, during a press run ink can begin to dry in the ink cells. A build-up of dried ink in the cells of the inking roller reduces the amount of ink transferred to the printing cylinder, and adversely affects printing quality.

SUMMARY OF THE INVENTION

The present invention is an improved ink fountain for presses employing a reverse angle doctor blade. The invention finds particular application in flexographic presses. However, in principle the invention may be employed in other presses, e.g. offset printing presses, where it is desirable to use a reverse angle doctor blade.

An ink fountain in accordance with the invention applies ink effectively and uniformly to an inking cylinder, even at speeds greatly increased as compared with conventional flexographic presses. The incidence of foaming within the ink fountain is greatly reduced, and the problem of premature drying of the ink is substantially eliminated.

More particularly, the present invention is an ink fountain for a printing press which includes an ink applicator, for bringing ink into contact with a portion of the inking roller, a knife preceding the ink applicator, and a reverse angle doctor blade, which follows the ink applicator and bears against the roller to scrape off excess ink. The knife is stiff and is closely spaced to the roller, at a predefined distance, preferably about 0.005 inches.

In a preferred embodiment, the ink applicator includes an ink cavity, bounded in the direction of rotation by the knife and doctor blade, which communicates with a portion of the roller. Ink is supplied to the cavity to be transferred to the roller surface, and a plurality of baffles are disposed in the ink cavity for controlling turbulence of the ink in the vicinity of the roller surface.

Preferably, a pre-inking applicator is provided, which includes an ink pan, in which a portion of the roller is immersed prior to reaching the ink applicator. At the outlet side of the ink bath, the roller engages a pre-wiper element or blade, which is closely spaced, approximately 0.005–0.010 inches, from the roller. The pre-wiper element has a leading face angled toward the roller in the direction of rotation of the roller. The angled face of the pre-wiper element forces ink, carried along by the rotating roller out of the ink pan, into contact with the roller surface as the roller leaves the bath. The pre-wiper element also pre-wipes the roller surface of excess ink.

The level of ink in the ink pan is preferably maintained at a predetermined level by an ink dam. The ink dam forms one wall of the ink pan, and either has a top edge, or openings therein, arranged at a predetermined height. Excess ink in the pan spills over into an outlet, where it is drained and returned to the ink reservoir. There, it can be recycled.

Preferably, the ink applicator includes an ink delivery system for introducing ink into the ink cavity through a plurality of spaced openings. An overflow is provided in the ink cavity to prevent excess pressure build-up therein. Ink which flows out of the ink cavity through the overflow outlet drains into the ink pan of the pre-inking applicator, so as to maintain sufficient ink in the pre-inker during operation of the press.

Preferably, a printing press in accordance with the invention is also provided with a cleaning system. In an illustrative embodiment, the ink delivery system to the cavity of the ink applicator may alternately be supplied with ink and a cleaning fluid, for example water for water-base inks. When it is desired to clean the roller, for example, at the end of a printing run or for overnight shutdown, the flow of ink is interrupted, and water is introduced into the cavity of the ink applicator for cleaning the cavity and the inking cylinder. At the same time, pressurized water is introduced through a plurality of water jets disposed on the other side of the inking roller, so as to clean thoroughly the ink cells in the printing roller. A brush is moved into resilient engagement with the roller surface to facilitate cleaning. Water sprayed at the cylinder through the water jets drains into the ink pan.

In conjunction with the spraying of the cylinder with water, the ink pan is provided with a means to drain the ink for cleaning. Preferably, the ink dam is pivotable to a cleaning position in which fluids in the ink pan can freely drain. An external handle or lever is coupled to the ink dam, so that the dam can be opened, and the ink pan drained, from the exterior of the press. This way, the cleaning cycle can be started quickly, before the ink dries.

In operation, the inking roller rotates first through the bath of ink in the ink pan so that it is pre-inked. As it rotates out of the ink pan, ink on the roller surface engages the bevelled surface of the pre-wiper, which forces the rotating ink into the cells of the roller. The traverse through the ink bath also tends to wash the surface of the inking roller, so as to remove lint and other contaminants which may have been picked up from the printing roller.

As the pre-inked roller surface approaches the ink applicator, it passes under the knife and into the cavity of the ink applicator, wherein ink is applied to fill any unfilled portions of the cells. Finally, the roller surface engages a reverse angle doctor blade. Due to the reverse angle of the blade, it scrapes off excess ink on the roller surface, so that after leaving the ink applicator, ink is retained only in the cells, and not on the surface, of the inking roller.

In conventional systems, as the fountain roller, or more commonly called the Anilox TM roller, rotates, it carries with it a boundary layer, approximately 0.065 inch thick, of laminar flow and stationary air (stationary relative to the roller surface). At press speeds of 1500 to 2000 feet per minute, the force of this rotating air is so strong that, as the roller rotates into contact with (non-rotating) ink in the ink fountain, it pushes all of the ink away from the roller, preventing the ink from filling the cells of the Anilox roller. Furthermore, the air introduced into the ink by the Anilox roller acts as an aerating system which causes the ink to foam. But it is the very essence of dipping the roller in ink, filling the cells, and then doctoring the surplus ink off, that makes the system work. If conventional flexographic presses are operated at press speeds in excess of about 1000 feet per minute, the difficulties described above arise and insufficient ink is provided to the printing cylinder.

A flexographic press employing an ink fountain in accordance with the invention can operate at high speeds without starvation and foaming. In the pre-inking application, the pre-wiper blade, which may be made of Delrin or any other plastic or phenolic compound, imparts a force to the ink, normally kept away from the roller by the laminar air layer, in a direction toward the roller surface, to force ink into the cells. As the rotating roller surface enters the ink applicator, the surface encounters a knife, which may be made of plastic (Delrin), which is closely spaced to the roller. The knife is set at a close distance, e.g. 0.005 inch, from the roller. The knife is stiff, i.e. non-flexible, so that as the roller surface passes under the knife, the knife interrupts the laminar boundary layer of air on the roller surface, and prevents such air from entering the applicator cavity. As a result, at the time the roller surface enters the ink applicator and comes into contact with the ink, ink in the cavity is free to engage the surface of the roller without the interference of an air boundary layer.

In addition, inside the applicator are a series of baffles, which break down the tremendous turbulence of ink under the high speed of the roller, forcing more ink into the cells.

The ink applicator is always supplied with fresh, lint-free ink. The ink in the pan pre-wets the Anilox roller and also cleans the roller from lint picked up by the plate and transferred to the roller. Also, in view of the use of a pre-inking bath and ink applicator at spaced locations around the ink roller, problems related to the drying of ink, which often occur in flexographic printing presses due to the use of fast drying inks, are avoided. The press can be used for long periods of time without being cleaned, and may be used for intermittent runs and readily cleaned between uses.

A flexographic ink fountain in accordance with the invention has successfully been tested in presses for the printing of newspaper and multicolor printing presses at speeds of up to 2000 feet per minute.

For a better understanding of the invention, reference is made to the following detailed description of a preferred embodiment, taken in conjunction with the drawing accompanying the application.

BRIEF DESCRIPTION OF THE DRAWINGS

FIG. 1 is a side sectional view, in schematic form, of a flexographic printing press having an ink fountain in accordance with the invention.

DETAILED DESCRIPTION OF A PREFERRED EMBODIMENT

A printing press includes an inking roller 10, which rotates in the direction of the arrow shown, and which contacts a printing cylinder 12. An ink applicator 14, which is described in detail below, includes a reverse angle doctor blade 16. Reverse angle doctor blade constructions, per se, are known. See. U.S. Pat. No. RE 24,161 to Rogge et al. A pre-inking applicator 18 is provided at the bottom portion of the inking roller 10, and a cleaning housing 20 is arranged adjacent the inking roller 10 opposite the ink applicator 14. A pair of side cover plates, one 22 of which is shown, are provided for containing ink. Similarly, the housings for the ink applicator 14, the pre-inking applicator 18 and the cleaning housing 20 have opposing side plates, one side being removed for the purposes of illustrating the internal structure.

The ink applicator 14 includes, in addition to the reverse angle doctor blade 16, a non-resilient knife 24, which is spaced close to the surface of the roller 10, and precedes the doctor blade 16. The edge of blade 24 is spaced at a precise distance, preferably about 0.005 inch, from the surface of the roller 10. The doctor blade 16 and knife 24 extend the width of the inking roller 10 and define the leading and trailing edges of an inking cavity 26, which communicates with a surface portion of the rotating roller 10. A plurality of baffles 28 are arranged in the cavity 26 for the purpose of reducing turbulence of ink introduced into the cavity 26.

A pump 20 is connected with a reservoir 32, and pumps ink under pressure into an inlet distribution system 34 communicating with the cavity 26. The inking distribution system 34 includes a multi-outlet manifold to further enhance the distribution of ink onto the roller surface. The manifold extends substantially the width of the press, and has openings to the cavity 26 at a plurality of widthwise locations.

Incorporated into the ink applicator 14 is an overflow system which includes overflow outlet 36 and pipe 38. The pipe 38 empties past a deflector 40 into pan 44 so that excess ink drains into the pre-inking applicator, as further described below.

The reverse angle doctor blade 16 may be adjusted to the desired position by an adjustment device 42. Also, the doctor blade support housing 43, which also incorporates the ink applicator 14, is pivotable about shaft 45 to be selectively pivoted back away from the roller 10. Doctor blade adjustment devices and pivot shaft mountings 43, 45, are well known in the art and need not be described further here.

The pre-inking applicator 18 includes an ink pan 44 for containing a bath of ink 46. The ink pan includes an ink dam formed by end plate 48 and a dam plate 62, the latter pivotable about a hinge pin 64. The dam plate 62 covers one or more holes in the end plate 48. When the dam plate 62 is pivoted to the open position, described below, ink 46 drains from the ink pan 44 through a discharge outlet 52.

Openings 50 in the end plate 48 communicate between the ink 46 and the discharge outlet 52 of the pre-inking applicator 18. The openings 50 may be a plurality of laterally extending slots formed in the ink dam at a predetermined height. Alternatively, in place of slots 50, the ink dam may be constructed so that its upper edge is at the desired height of the ink 46. The height of the openings 50 is chosen such that about ⅛ of the inking cylinder 10 is immersed in the ink 46.

The pre-inking applicator 18 also includes a pre-wiper element or blade 54, which is supported at a predefined distance from the surface of the roller 10, preferably 0.005–0.010 inches. The pre-wiper element 54 has a leading face 55 which is angled toward the roller 10, in the direction of roller rotation, and is mounted on a plate 56, which is attached to a spring hinge 58. The spring hinge 58 urges the plate 56 against a stop 60. The stop 60 and spring hinge 58 are fixed to one end of the plate 48, which in the position shown supports the pre-wiper element 54 at the desired spacing from the roller 10. At the same time, if the ink roller 10 is taken off impression (lowered), the hinge 58 permits the pre-wiper element 54 to rotate counterclockwise out of the way.

The dam plate 62, which is pivotable about fixed pivot 64, can be rotated from the position shown, where the plate 62 retains the ink 46 in the pan 44, to an open position, in which dam plate 62 pivots in the direction of arrow 72, for draining ink 46 in the pan 44. To facilitate moving of the dam plate 62 between the operating and drainage positions, a bar linkage 66 is coupled between the plate 62 and an external lever 68, which is fixed on a shaft 70. Ink drained from the pan, either during cleaning operations or as a result of overflow through openings 50, is recirculated through the outlet 52 and returned to the ink reservoir 32.

The cleaning housing 20 includes a plurality of water jets 74 which are directed to spray pressurized water on the surface of the inking roller 10 for cleaning thereof. A brush 76 is selectively moveable into and out of engagement with the roller surface. A pneumatic piston-cylinder unit 78 is operable to move connecting arm 80, which causes shaft 81 to pivot. The brush mounting 76 is fixed on the common shaft 81 with arm 80, so as to move toward or away from the roller 10 when unit 78 is actuated. In the cleaning position shown, the brush 76 engages the roller surface.

As also indicated schematically in FIG. 1, the ink cavity 26 includes a system for delivering water. Pressurized water may selectively be introduced into the delivery pipe 34 for introduction into the cavity 26. A valve 84, and counterpart valve 86 in the ink delivery system, may be operated to selectively shut off the supply of pressurized ink and deliver pressurized water into the cavity 26 for cleaning.

In a printing operation, ink is supplied from a pump 30, through a filter, the valve (open) 86, and delivery system 34, and into the cavity 26 of the ink applicator 14. The inking cylinder 10 is partially disposed in the ink 46 in the ink pan 44 of the pre-inking applicator 18. In the manner discussed above, the roller 10 rotates first through the ink applicator 18 where ink is picked up on the roller surface and forced into the cells of the Anilox roller by the pre-wiper element 54. The pre-inked surface then rotates past knife 24. The knife 24, being stiff and spaced very close to the roller surface, shears off the air boundary layer, and the pre-inked surface, minus a rotating boundary layer, rotates into communication with the cavity 26. Ink, which flows around the baffles 28, is free to enter the cells of the roller 10. Thereafter, the doctor blade 16 scrapes off excess ink from the roller surface, and the roller, containing ink only in the cells, rotates into contact with the printing cylinder 12.

During such time, excess ink in the applicator 14 flows out through hole or slot 36, down duct 38, past a splash plate 40, and into the ink pan 44 so as to maintain an adequate supply of ink in the ink pan. Excess ink in the ink pan exits through holes or slots 50, drains through outlet 52, and is returned to the reservoir.

At the end of a printing run, the system can readily be cleaned. The press operator depresses lever 68 to drain the ink 46 from the pan 44, which exits to the reservoir 32. With the ink dam 62 moved to the cleaning (open) position, hydraulic cylinder 78 is actuated to rotate the brush 76 into engagement with the surface of the roller 10, and water jets 74 are turned on. At the same time, valve 84 is opened (valve 86 being closed) and pressurized water is introduced into the delivery system 34, to flow into the cavity 26, and out though the overflow system 36, 38. The cleaning water and residue ink drain into the ink reservoir for recycling. At the end of the cleaning cycle, the entire doctor blade housing can be rotated away from the cylinder, about pivot 45, to drain any remaining water in the cavity 26. If desired, the pre-inking applicator may be lowered for inspection and/or additional cleaning, or to remove the ink roller, using any suitable mechanism for raising and lowering the housing.

Also, if desired, the entire cleaning cycle may be operated by a single pushbutton or switch, using conventional actuators and time delays for activating the lever 68, valves 84 and 86, cylinder 78 and water jets 74 in the desired sequence for the appropriate durations.

When restarting, ink concentrate is added, to reconstitute the now diluted ink in the reservoir, and additional quantities of ink concentrate and water may be added in appropriate proportions to increase the volume of ink in the reservoir.

The invention has been shown and described with reference to a preferred embodiment thereof. Variations and modifications of the invention will be apparent to persons skilled in the art without departing from the inventive concepts disclosed herein. All such modifications and variations are intended to be within the scope of the invention as defined in the following claims.

I claim:

1. In a printing press having a roller and ink fountain means for applying ink to said roller, the improvement wherein said ink fountain means comprises:

a knife means closely spaced to said roller for interrupting the boundary layer of air on said roller surface;

ink applicator means for bringing ink into contact with a first portion of said roller, wherein said first portion is adjacent, in the rotational direction of said roller, said knife means;

a reverse angle doctor blade bearing against said roller for scraping excess ink from said roller, said doctor blade being arranged adjacent, in the rotational direction of said roller, said portion; and a pre-inking applicator means for bringing ink into contact with a second portion of said roller, said pre-inking applicator means being spaced from, and arranged, in the direction of rotation, preceding said ink applicator means.

2. The improvement as claimed in claim 1, wherein said pre-inking applicator means comprises a pre-wiper element closely spaced from said roller and arranged, in the direction of rotation, following said second portion.

3. The improvement as claimed in claim 2, wherein said pre-wiper element has a leading face angled toward said roller in the direction of rotation of said roller, for forcing ink against said roller.

4. The improvement as claimed in claim 3, wherein said pre-wiper element is spaced approximately 0.005–0.010 inch from said roller.

5. The improvement as claimed in claim 4, wherein said pre-inking applicator means comprises an ink pan, in which said roller is partially immersed, having means for establishing a constant level of ink.

6. The improvement as claimed in claim 5, wherein said ink applicator means comprises a cavity communicating with said first portion, means for supplying ink to said cavity, and at least one baffle disposed in said cavity for controlling turbulence of ink at said first portion, and wherein said ink applicator means includes overflow means for controlling pressure build-up in said ink applicator means.

7. The improvement as claimed in claim 6, wherein said overflow means is arranged to discharge ink into said ink pan.

8. The improvement as claimed in claim 7, comprising means for selectively introducing a fluid into said cavity for cleaning said ink applicator means and said roller.

9. The improvement as claimed in claim 7, comprising means for draining said ink pan, and means spaced from said ink applicator means for directing pressurized cleaning fluid at said roller.

10. The improvement as defined in claim 9, wherein the means for directing pressurized fluid is spaced from said pre-inking applicator means and includes brush means bearing against said roller and means for communicating said pressurized fluid from said roller into said ink pan.

11. The improvement as claimed in claim 8, comprising means for draining said ink pan and means for directing the cleaning fluid from the roller into the ink pan, wherein the means for draining said ink pan and for maintaining a level of ink comprises an ink dam pivotable between an operating position, for maintaining ink in said pan at a predetermined level, and a cleaning position, in which ink in said pan is drained.

12. The improvement as claimed in claim 11, comprising means external to said ink pan and coupled to said ink dam for moving said ink dam between operating and cleaning positions.

13. A method of applying ink to a roller in a printing press comprising the steps of:

rotating said roller past a knife means, spaced a distance from the surface of said roller, for interrupting the boundary layer of air on said roller surface;

bringing ink into contact with a first portion of said roller, said first portion being adjacent, in the rotational direction of said roller, to said knife means;

applying a reverse angle doctor blade against said roller for scraping excess ink from said roller, wherein said doctor blade is arranged adjacent, in the rotational direction of said roller, said first portion; and bringing ink into contact with said roller at a second portion thereof preceding said first portion for pre-inking the roller, and arranging a pre-wiper element at a distance closely spaced from said roller, after pre-inking, at an angle for forcing ink into contact with said roller.

14. A method as defined in claim 13, wherein ink is supplied from a reservoir, wherein ink for pre-inking is maintained in an ink pan and applied to said roller by partially immersing said roller into said ink pan, and comprising the steps of periodically providing a fluid to said cavity for cleaning said cavity and said roller, directing fluid under pressure at the surface of said roller, at a location spaced from said cavity, for cleaning said roller, flowing said fluid to said ink pan, and draining said ink pan into said reservoir for recirculation of said ink and fluid.

15. In a printing press having a roller and ink fountain means for applying ink to said roller, the improvement wherein said ink fountain means comprises:

ink applicator means for bringing ink into contact with a first portion of said roller;

a reverse angle doctor blade bearing against said roller for scraping excess ink from said roller, said doctor blade being arranged adjacent, in the rotational direction of said roller, said first portion; and a pre-inking applicator means for bringing ink into contact with a second portion of said roller, said pre-inking applicator means being spaced from, and arranged, in the direction of rotation, preceeding said ink applicator means, wherein said pre-inking applicator means comprises a pre-wiper element closely spaced from said roller and arranged, in the direction of rotation, following said second portion, and wherein said pre-wiper element has a leading face angled toward said roller in the direction of rotation of said roller, for forcing ink against said roller.

* * * * *